United States Patent [19]

Witte

[11] 4,106,213

[45] Aug. 15, 1978

[54] EXHAUST RECIRCULATION SYSTEM FOR CLOTHES DRYER

[76] Inventor: Earl L. Witte, Rte. 6, Clinton Rd., Paducah, Ky. 42001

[21] Appl. No.: 786,621

[22] Filed: Apr. 11, 1977

[51] Int. Cl.[2] ..... F26B 21/08

[52] U.S. Cl. ..... 34/79; 34/82; 34/85; 55/380

[58] Field of Search ..... 34/79, 80, 82, 85, 90; 55/380, 528

[56] References Cited

U.S. PATENT DOCUMENTS

| | | | |
|---|---|---|---|
| 2,753,952 | 7/1956 | Engel | 34/82 X |
| 3,197,886 | 8/1965 | Brame et al. | 34/90 |
| 3,535,855 | 10/1970 | Howard et al. | 55/380 |
| 3,716,925 | 2/1973 | Hartung | 34/80 |

*Primary Examiner*—Edgar W. Geoghegan

*Attorney, Agent, or Firm*—Lowe, King, Price & Markva

[57] ABSTRACT

A device for recirculating warm, moist air from a clothes dryer exhaust into a room is attached to the standard vent pipe of the dryer. The device comprises a length of corrugated, sheet aluminum tubing having a substantially right-angled bend. One end of the tubing is placed on the dryer vent pipe. The opposite end of the tubing beyond the bend extends parallel to the side of the dryer and slips into a double ply, nylon mesh, filter bag. The bag is releasably secured to the end of the tubing with a resilient band which seats within an annular recess formed at the end of the tubing. The tubing has an approximately elliptical profile beyond the right-angled bend so that the dryer can be located close to an upstanding wall for best floor space utilization. The nylon mesh prevents sticking by lint and other materials exhausted by the dryer for easy emptying.

6 Claims, 5 Drawing Figures

EXHAUST RECIRCULATION SYSTEM FOR CLOTHES DRYER

BACKGROUND OF THE INVENTION

The present invention relates generally to an energy conservation apparatus for recirculating warm, moist air exhausted by a clothes dryer, and more particularly, toward a simple device adapted to be attached to the conventional dryer vent pipe and carrying a special filter bag that can be periodically detached from the device and emptied.

The conventional clothes dryer used in households across the country heats the clothes during tumbling to cause forced evaporation of moisture. The warm, moist air developed by the dryer is normally vented out a vent pipe through a wall or window to the outside. In typical natural gas or electric clothes dryers, approximately 20,000 to 30,000 BTU's per hour are generated while the dryer is in use, and most are essentially wasted once the warm, moist air has been exhausted from the dryer.

In view of rising requirements throughout the nation, it has become necessary to make maximum use of all available energy. One way of maximizing energy consumption efficiency is to use the warm, moist air exhausted by the clothes dryer for heating and humidifying the home. The concept of using the clothes dryer exhaust for humidifying the home is shown in U.S. Pat. No. 3,716,925 to Hartung. Therein, a relatively complex venting system disposed between the dryer and outdoor vent includes a manually operated vent plate located in a length of straight tubing having an opening around which is placed a cylindrical filter. The filter is formed by a spaced apart pair of imperforate discs, around which is secured a foraminous wall and filter blanket. While generally somewhat satisfactory, the Hartung system is relatively expensive and is difficult to install since it requires outdoor venting. Furthermore, since there is outdoor venting, there is heat loss to the outdoors even when the vent plate is operated to deflect the dryer exhaust through the cylindrical filter into the room. Still further, because the cylindrical filter is of a substantially larger diameter than the vent tube, the dryer must be located away from a wall to provide clearance for the filter, thereby wasting floor space.

Accordingly, one object of the present invention is to provide an improved device for recirculating warm, moist air exhausted from a clothes dryer within a room for energy conservation.

Another object of the invention is to provide a dryer exhaust recirculation device which does not require the provision of any outdoor venting.

Another object is to provide a dryer exhaust recirculation device that is easily manufactured and readly installed.

Still another object of the present invention is to provide a dryer exhaust recirculation device having a filter bag that is readily detached for emptying.

Yet another object of the present invention is to provide a dryer exhaust recirculation device which permits the dryer to be located close to a wall to minimize the amount of floor space used.

SUMMARY OF THE INVENTION

A device adapted to be attached to the conventional vent pipe of a gas or electric clothes dryer for recirculating warm, moist air exhausted by the dryer comprises a length of corrugated, sheet aluminum tubing preformed with a substantially right-angled bend. One end of the tubing is fitted over the vent pipe of the dryer, and the opposite end is adapted to be slipped inside the opening of a double ply, nylon mesh, filter bag. The corrugated structure of the tubing permits the diameter of the tubing to remain approximately constant along the right-angled bend, but the tubing is slightly flattened to an approximately elliptical profile beyond the bend so that the dryer may be located close to a wall. The end of the tubing opposite the dryer vent contains an annular recess. The filter bag is releasably secured to the end of the tubing with a resilient band that seats in the recess.

The device is attached to the dryer by simply locating the corrugated tubing over the vent pipe of the dryer and extending the tubing beyond the right-angled bend approximately horizontally, inclined slightly upwardly; no outside venting is required. During use of the dryer, warm, moist air exhausted from the dryer is recirculated into the room through the filter bag. The bag, which has an elongated configuration, tends to straighten out under the force of the dryer exhaust in order to minimize the filter surface area. The approximately horizontal orientation of the tubing prevents blockage of the vent by fold-over of the filter bag.

Periodically, the filter bag is detached from the corrugated tubing and emptied. The nylon mesh material prevents sticking by lint and other materials exhausted from the dryer.

Still other objects and advantages of the present invention will become readily apparent to those skilled in the art from the following detailed description wherein I have shown and described only the preferred embodiment of the invention, simply by way of illustration of the best mode contemplated by me of carrying out my invention. As will be realized, the invention is capable of other and different embodiments, and its several details are capable of modification in various obvious respects, all without departing from the invention. Accordingly, the drawings and description are to be regarded as illustraive in nature, and not as retrictive.

DETAILED DESCRIPTION OF A PREFERRED EMBODIMENT

Figure 2:
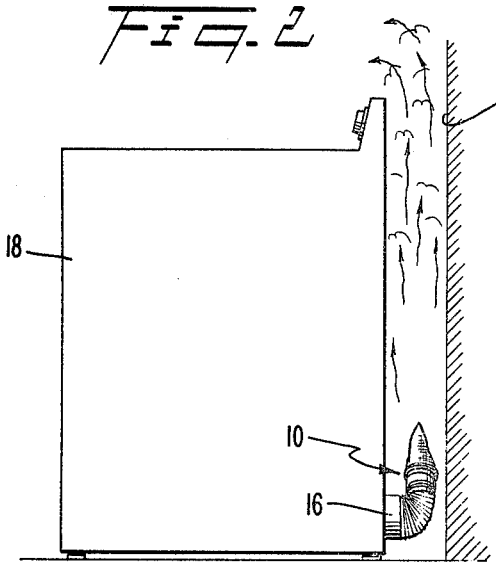
FIG. 2 is a side view of a conventional dryer having attached thereto a dryer exhaust recirculation device, in accordance with the invention.
Figure 1:
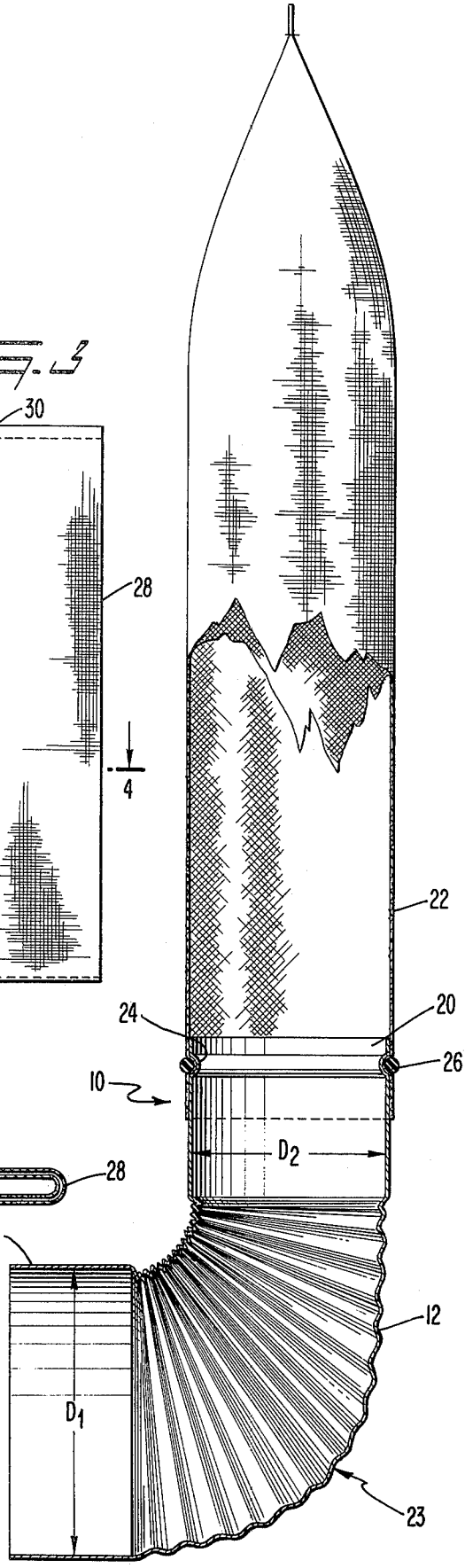
FIG. 1 is a cross sectional side view of the recirculation device with a portion of the filter bag broken away to expose the double ply construction thereof.

Referring to FIGS. 1 and 2, a dryer exhaust recirculation device 10, in accordance with the invention, comprises a length of sheet aluminum tubing 12 having one end 14 thereof adapted to be attached to the conventional vent pipe 16 of a gas or electric clothes dryer 18, and an opposite end 20 fitted inside a filter bag 22. Tubing 12 is formed with a substantially right-angled bend at 23, as shown, and is corrugated so as to maintain the cross sectional area (FIG. 1) of the tubing approximately constant along the bend. The profile of the tubing at the end 14 is circular having the diameter $D_1$, but the profile at the opposite end 20 is somewhat flattened so as to be approximately elliptical having a minor axis diameter $D_2$, where $D_2 < D_1$ (FIG. 1) to permit the dryer 18 to be located close to a wall W to minimize floor space use, as shown in FIG. 2.

End 14 of tubing 12 is adapted to be slipped over the standard vent pipe 16 so that no special tools for installation of device 10 are required, however, the end 14 may optionally be secured to the vent pipe 16 with self-tapping screws.

At the opposite end 20, there is provided an annular recess 24 into which is seated a resilient ring 26. The purpose of the ring 26 is to releasably secure filter bag 22 to end 20 of the tubing 12, as shown. In this manner, the filter bag 22 can be periodically released from the device 10 without removing the tubing 12 from vent 16. After emptying, filter bag 22 is replaced on end 20 of the tubing 12 by rolling ring 26 along the tubing toward the corrugated, right-angled portion 23, slipping the bag over the tubing, and then rolling the ring back over the bag until the ring becomes seated within the annular recess.

Figure 3:
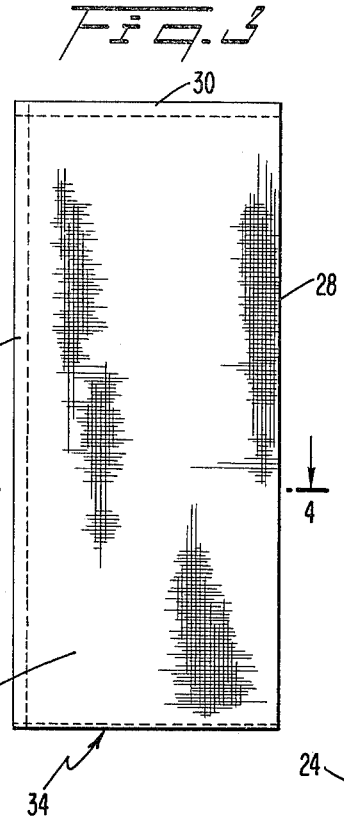
FIG. 3 is a side view of the nylon mesh filter bag detached from the corrugated tubing of the recirculation device.
Figure 5:
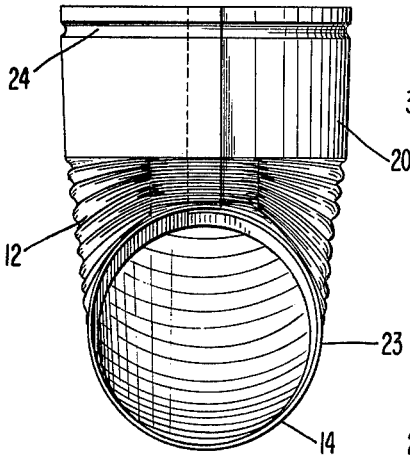
FIG. 5 is an end view of the recirculation device showing the somewhat flattened, upstanding end portion that may be located near or against a wall to minimize floor space utilization by the dryer.
Figure 4:
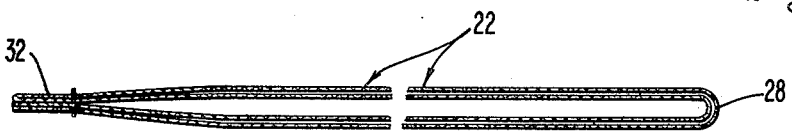
FIG. 4 is a cross sectional side view of the filter bag taken along the line 4—4 in FIG. 3.

The filter bag 22 is shown in more detail in FIGS. 3 and 4. Bag 22 is rectangular and elongated, as shown in FIG. 3, and is folded over at sides 28 and sewn at sides 30 and 32, thereby providing a single opening at 34. The bag 22 is made from double ply, nylon mesh, as best seen in FIG. 4, to provide optimum filtering while minimizing resistance to flow of exhaust air. The nylon mesh is preferably 114A-SHS MEL nylon fabric, manufactured by Lamports Company, Cleveland, Ohio, although an equivalent nylon mesh could be used. The purpose of using nylon mesh is to prevent sticking of lint and other materials exhausted from the dryer 10 so that bag 22 can be completely emptied by shaking, and there is no necessity to rinse the bag with cleaning fluid.

In practice, the tubing 12 of device 10 is oriented on vent pipe 16 so that the end 20 of the tubing extends approximately horizontally with slight upward incline to prevent the filter bag 22 from blocking vent pipe 16 by folding over when the dryer 18 is not in use. When dryer 18 is in use, the filter bag 22 tends to elongate outwardly, as shown in FIG. 2, under the pressure of the exhaust. The bag 22 also tends to fully open, thereby maximizing the effective surface area of the bag for filtering.

I have found that by using my recirculation device 10 on a typical gas or electric dryer, I am able to save 20,000 to 30,000 BTU's per hour while the dryer is in use by recirculating the warm, moist air from the dryer back into the home, rather than exhausting it outdoors. Furthermore, the aditional humidity added to the air in the home adds to comfort. Even when the dryer is in the basement of a home, the recirculated dryer exhaust tends to be drawn into the air inlet of the furnace for distribution throughout the home.

In this disclosure, there is shown and described only the preferred embodiment of the invention, but, a aforementioned, it is to be understood that the invention is capable of use in other and different embodiments and is capable of changes or modifications within the scope of the inventive concept as expressed herein.

What is claimed is:

1. A device adapted to be attached to an exhaust vent pipe of a clothes dryer for recirculating exhausted air within a room, comprising:

a length of tubing formed with a substantially right angled bend, one end of said tubing having a circular cross section and a diameter substantially equal to the diameter of said vent pipe for mounting to said vent pipe, the opposite end of said tubing extending parallel to an outer surface of the clothes dryer and adapted to be located adjacent an upstanding wall;

a filter bag;

means for releasably securing said filter bag on said opposite end of said tubing;

said filter bag being adapted to extend outwardly between the dryer and the wall, said opposite end of said tubing having an approximately elliptical cross section with the major axis thereof oriented parallel to said wall, said filter bag having a circumference approximately equal to the circumference of said opposite end of said tubing, thereby enabling said dryer to be positioned closely adjacent said wall; and means for supporting said device on said dryer vent pipe.

2. The device of claim 1, wherein said securing means includes a resilient band having a circumference corresponding to a circumference of said opposite end of said tubing.

3. The combination of claim 2, wherein said tubing contains an annular recess at said opposite end thereof forming a seat for said resilient band.

4. The device of claim 1, wherein said tubing is corrugated to maintain an approximately constant cross sectional area along the right angled bend.

5. The device of claim 1, wherein said filter bag is formed of a nylon mesh to prevent sticking thereto of lint and other materials exhausted by said dryer.

6. The device of claim 5, wherein said filter bag is formed of a double ply, nylon mesh material.

* * * * *